US005152406A

United States Patent [19]

Kling et al.

[11] Patent Number: 5,152,406

[45] Date of Patent: Oct. 6, 1992

[54] PODIUM FOR A LUBRICATING DISPENSER

[75] Inventors: Gary W. Kling; Jerry D. Shew, both of Charlotte, N.C.; Theodore W. Beise, Arlington Heights, Ill.

[73] Assignee: Stewart Warner Alemite Corporation, Charlotte, N.C.

[21] Appl. No.: 607,901

[22] Filed: Oct. 1, 1990

[51] Int. Cl.[5] ..... A47F 7/00

[52] U.S. Cl. ..... 211/70.6; 222/173

[58] Field of Search ..... 211/13, 60.1, 70.6; 222/173, 192; 15/339; 312/223; 184/1.5

[56] References Cited

U.S. PATENT DOCUMENTS 2,477,450 7/1949 Gray ..... 184/1.5 X
4,193,487 3/1980 Takeuchi ..... 184/1.5 X
4,880,144 11/1989 Shea ..... 222/173

OTHER PUBLICATIONS

Advertisement "Lincoln Model 4010 Lubricaton Station" Form 440527, Copyright 1989.

*Primary Examiner*—Robert W. Gibson, Jr.
*Attorney, Agent, or Firm*—Lorusso & Loud

[57] ABSTRACT

A podium for a lubricating dispenser, the podium including an upright support structure, a housing attached to the support structure, a shelf attached to the support structure and extending over the housing, the shelf having mounting means thereon for receiving and retaining the lubricating dispenser, the shelf having a trough therein, the housing having a hole in an upper surface thereof, the hole being adapted for a hose to pass therethrough from the housing to the dispenser, the mounting means being adapted to receive the dispenser such that a grip portion of the dispenser extends outwardly from the support structure and the nozzle portion of the dispenser extends inwardly toward the support structure and over the trough.

13 Claims, 6 Drawing Sheets

PODIUM FOR A LUBRICATING DISPENSER

BACKGROUND OF THE INVENTION

1. Field of the Invention

This invention relates to utility tables and is directed more particularly to a podium for lubricating dispensers of the type used in lubrication of vehicles.

2. Description of the Prior Art

It is known in the art to provide a console unit for holding lubricant dispensers, such as grease guns, and the like, used to lubricate vehicles. The console typically holds the dispensers and the hoses attached thereto, and provides shelf space for other items.

U.S. Pat. No. 4,880,144, issued Nov. 14, 1989, in the name of Robert F. Shea, is representative of such prior art units. The '144 patent discloses a console for holding lubricant dispensers and hoses attached thereto, provides shelf space for other items, and in the particular embodiment shown, provides a compartment for the storage of a vacuum machine, and has a bracket for holding a vacuum hose.

In the '144 device, there are provided front and side walls, with the rear of the console being open for access. Accordingly, to retrieve an item from a shelf, an operator must proceed to the rear of the unit and withdraw the item. In the '144 device, the lubricant dispensers are retained such that the nozzles of the dispensers, when the dispensers are at rest in the console, are directed outwardly from the console, such that drippage therefrom results in lubricant dripping onto the floor of the work area, and an accidental triggering thereof, results in lubricant being dispensed in a direction toward an operator, either of which can constitute a safety hazard.

It would be beneficial to the industry to have available a console of the type described in the '144 patent, but without the obstructing side walls, and with facility for positioning retained lubricant dispensers such that either drippage therefrom, or accidental discharge thereof, will result in errant lubricating fluid being caught safely and retained in the console unit.

SUMMARY OF THE INVENTION

With the above and other objects in view, as will hereinafter appear, a feature of the present invention is the provision of a podium for a lubricating dispenser, the podium comprising support means adapted to stand upright on a horizontal floor, a housing attached to the support means, the housing having a top wall extending transversely of the upright support means, the top wall having a hole therein adapted to have disposed therein a lubricating dispenser hose, the hose extending from the housing through the hole and connected to the dispenser, and shelf means attached to the support means and extending over the top wall, the shelf means having mounting means thereon for receiving and retaining the lubricating dispenser with a nozzle portion of the dispenser directed toward the support means, the shelf means defining a trough positioned to underlie the dispenser nozzle when the dispenser is mounted on the mounting means, such that a grip portion of the dispenser extends outwardly away from the support means and the nozzle portion of the dispenser extends inwardly toward the support means and over the trough.

In accordance with a further feature of the invention, there is provided a shield means mounted on the podium and extending upwardly from the shelf means, the shield means comprising an upstanding wall positioned in front of the nozzle portion of the dispenser when the dispenser is mounted on the mounting means, such that the shield wall is disposed in a trajectory of lubricating oil dispensed from the dispenser when the dispenser is mounted on the mounting means and activated by an operator.

In accordance with a still further object of the invention, the shield means is configured to guide the oil dispensed thereagainst into the trough.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENTS

Figure 1:
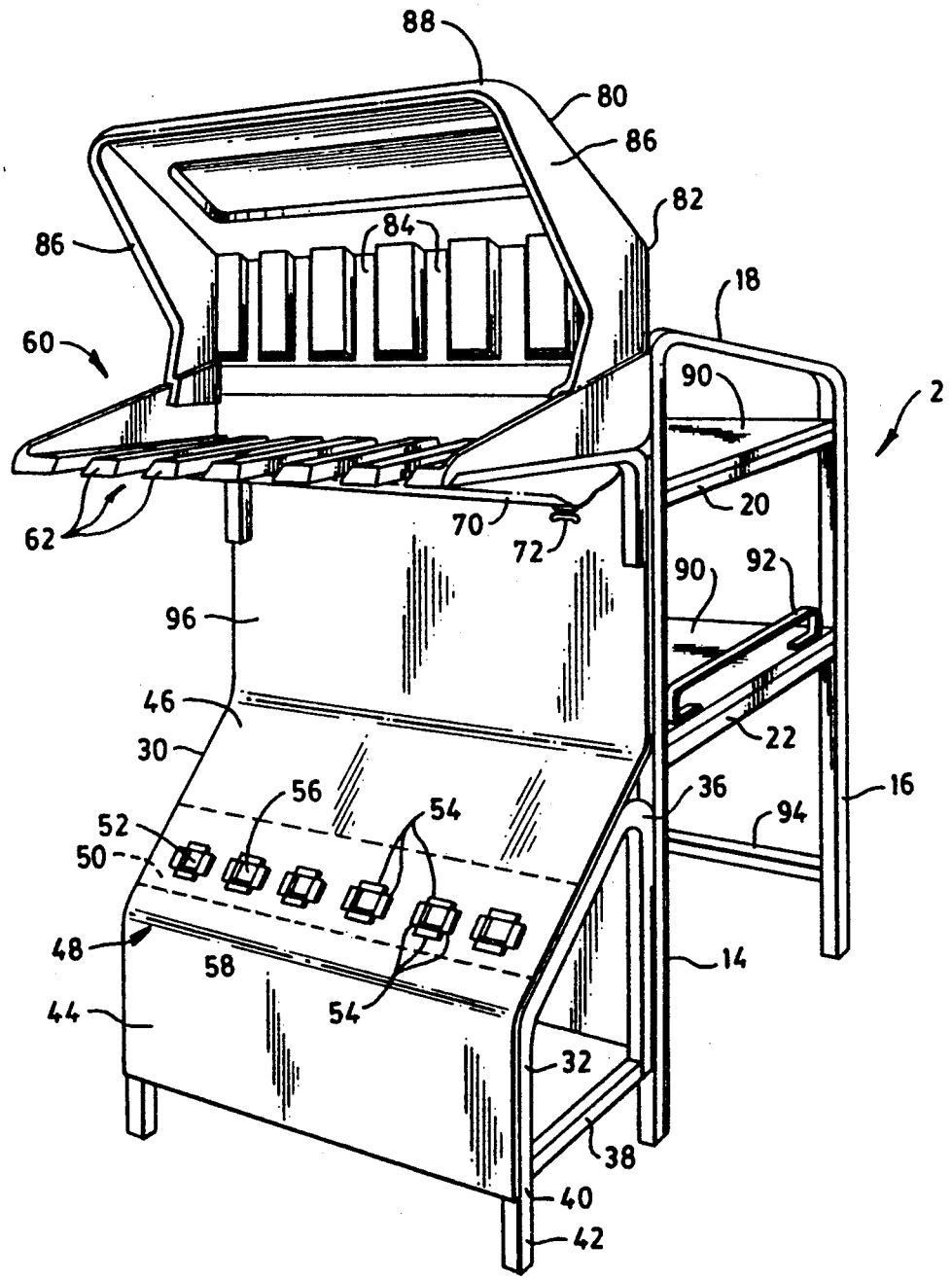
FIGS. 1 and 2 are perspective views of one form of podium for lubricating dispensers, illustrative of an embodiment of the invention.
Figure 2:
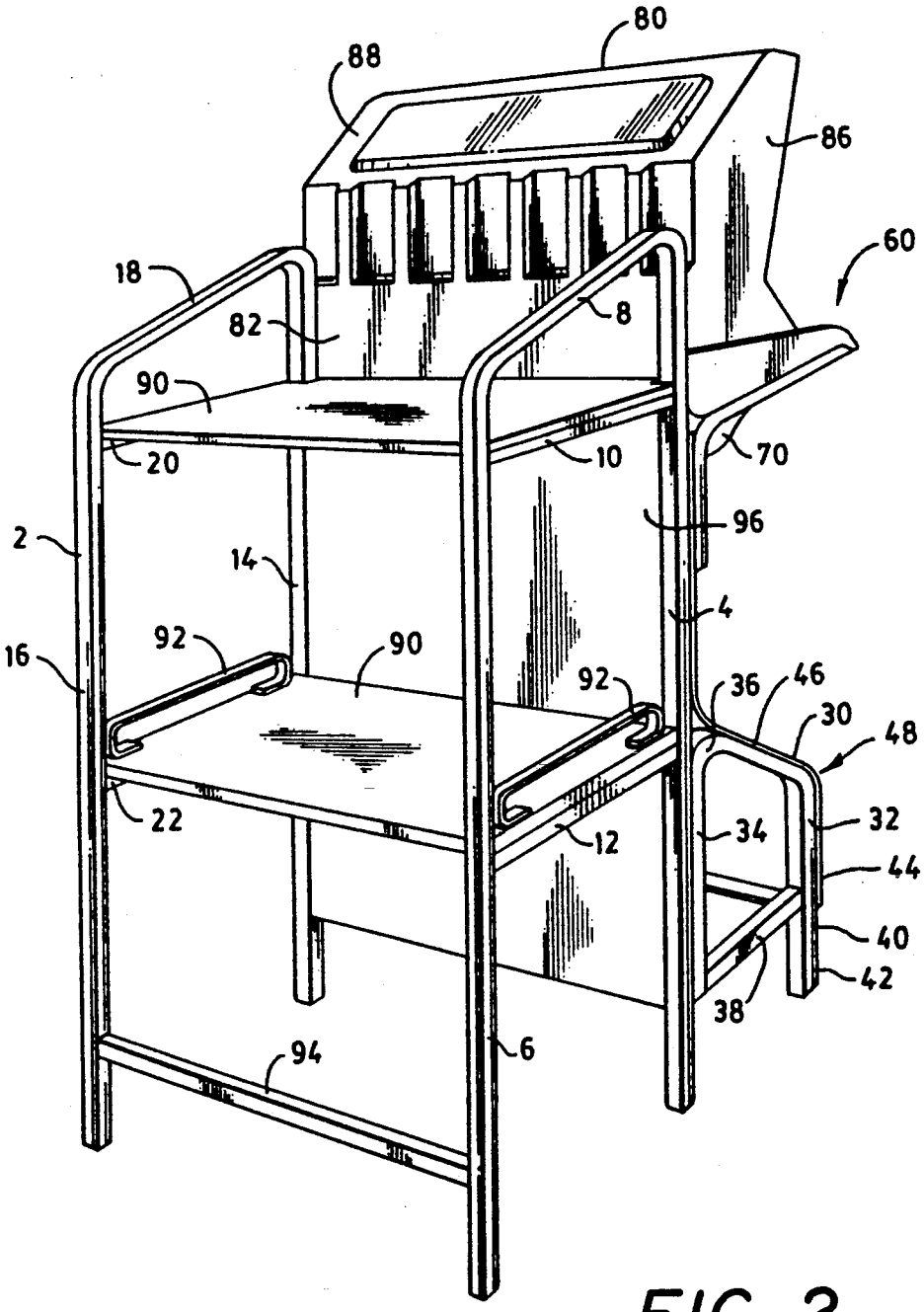
Figure 3:
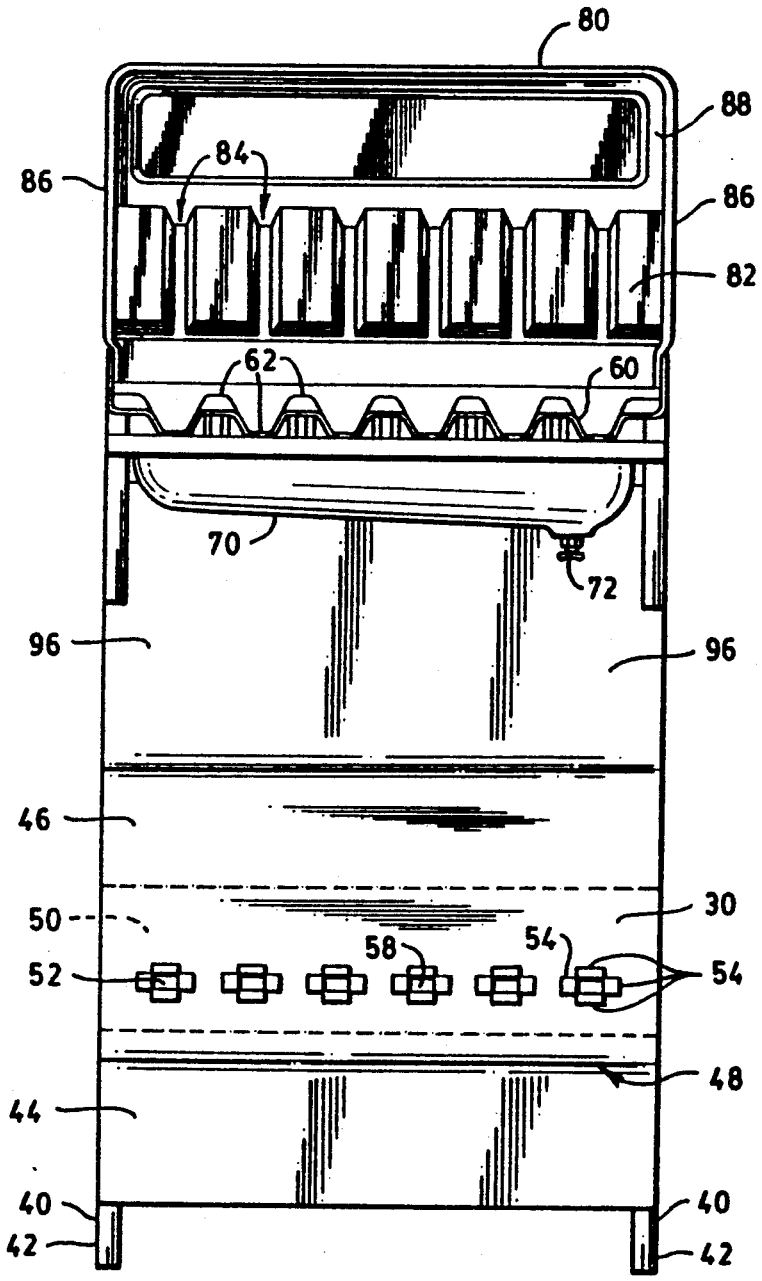
FIG. 3 is a front elevational view of the podium of FIGS. 1 and 2.

Referring to the drawings, it will be seen that an illustrative embodiment of the inventive lubricating podium comprises a support means 2 adapted to stand upright on a horizontal floor. The support means 2 preferably comprises front and rear right side legs 4, 6, interconnected at their upper ends by a right side top bar 8. The right side legs 4, 6 may be further interconnected by shelf-supporting right side bars 10, 12. The support means 2 further comprises front and rear left side legs 14, 16, interconnected at their upper ends by a left side top bar 18. The left side legs 14, 16 may be further interconnected by shelf-supporting left side bars 20, 22. The structural members 4, 6, 8, 10, 12, 14, 16, 18, 20, 22 thus comprise a skeletal frame to which may be attached, or on which may be mounted, the various receiving and retaining means described hereinafter.

A housing 30 is attached to the support means 2 and includes frame members 32, 34, joined together at one end 36, and interconnected therebelow by side bars 38. Portions 40 of the frame members 32 may extend beneath the side bars 38 and serve as additional legs 42 for the podium. Fixed to the frame members 32 is a housing front wall 44 and a housing top wall 46, the top wall 46 extending transversely to the upright portions of the support means. The walls 44 and 46 may be a single sheet bent along a horizontal line 48 to provide the two walls 44, 46.

Figure 4:
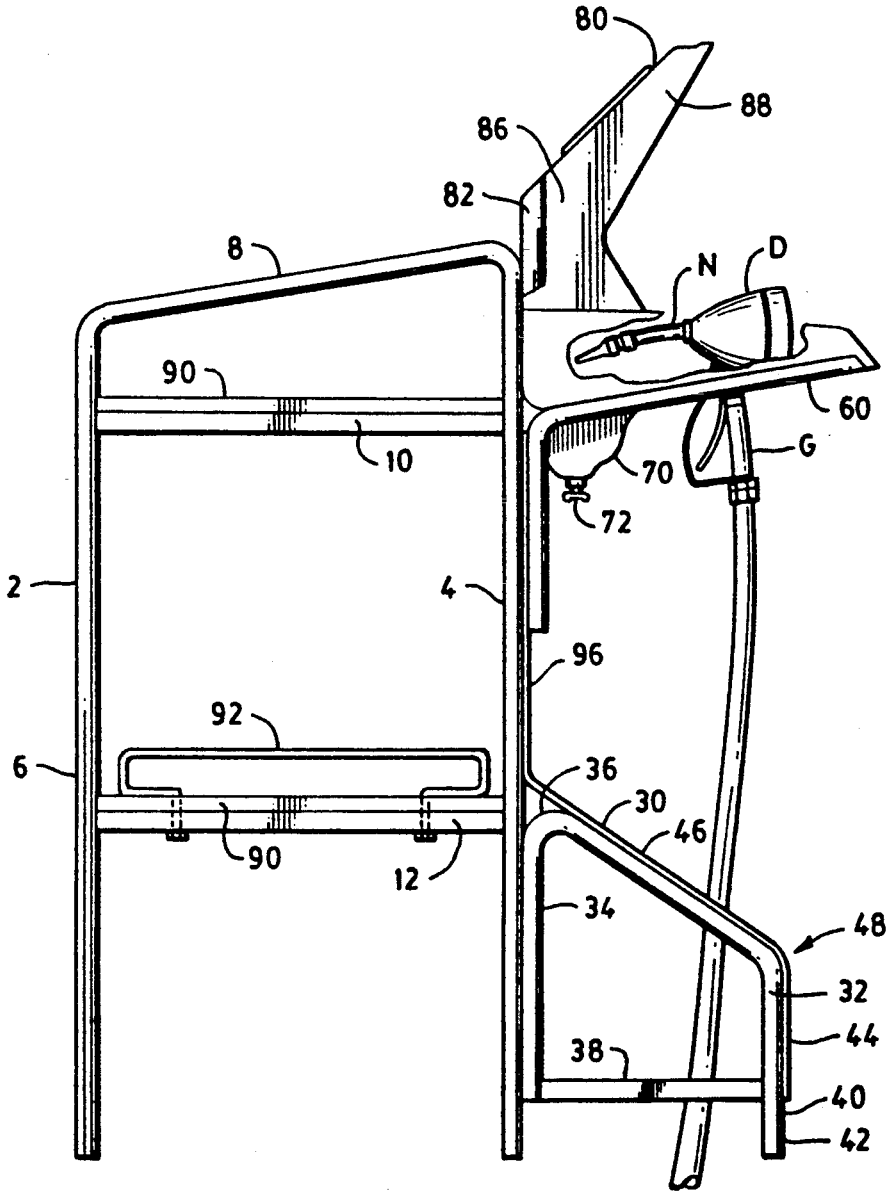
FIG. 4 is a side elevational view thereof, partly broken away and shown with a lubricant dispenser mounted on the podium.
Figure 5:
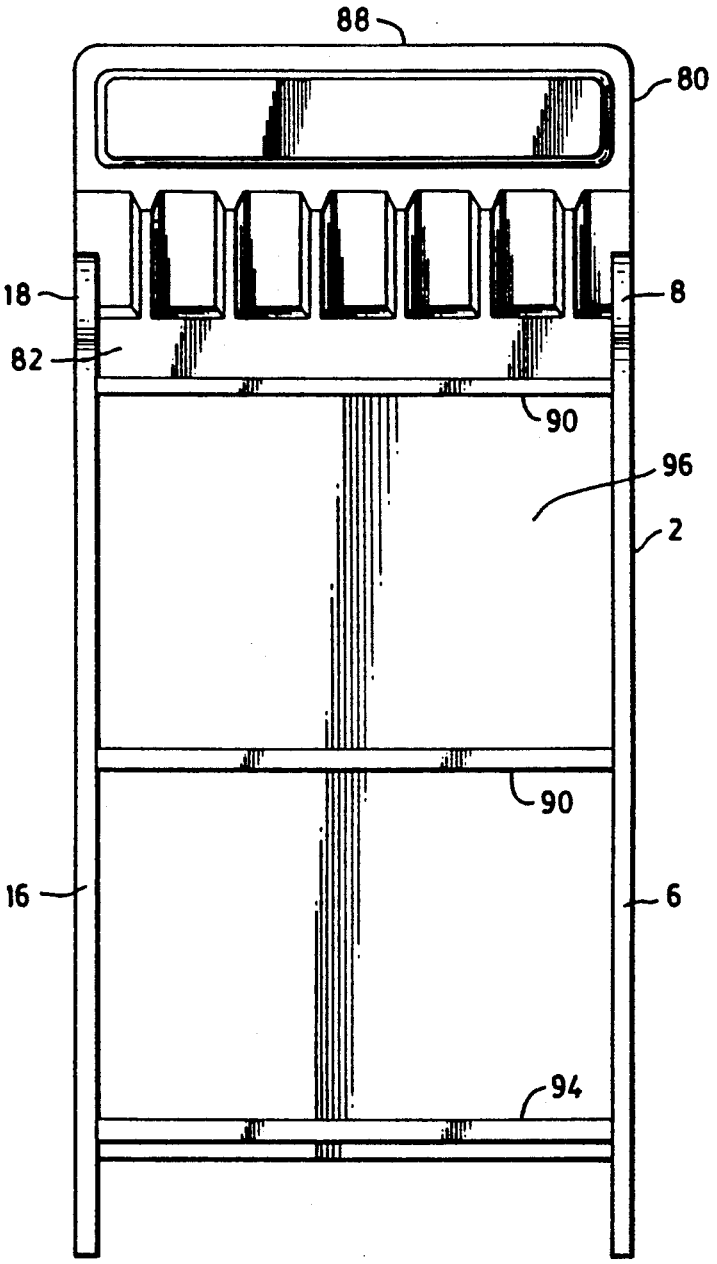
FIG. 5 is a rear elevational view thereof.

A roller plate 50 is attached to an undersurface of the housing top wall 46 and has therein hole means 52, each of the hole means having mounted adjacent thereto and extending somewhat thereover, four rollers 54. Each of the hole means 52 is aligned with an opening 56 in the housing top wall 46, such that the rollers 54 define rollerway means 58 through which may readily move a hose H interconnecting a lubricating oil pump (not shown) and a lubricating oil dispenser D (FIG. 4).

Figure 6:
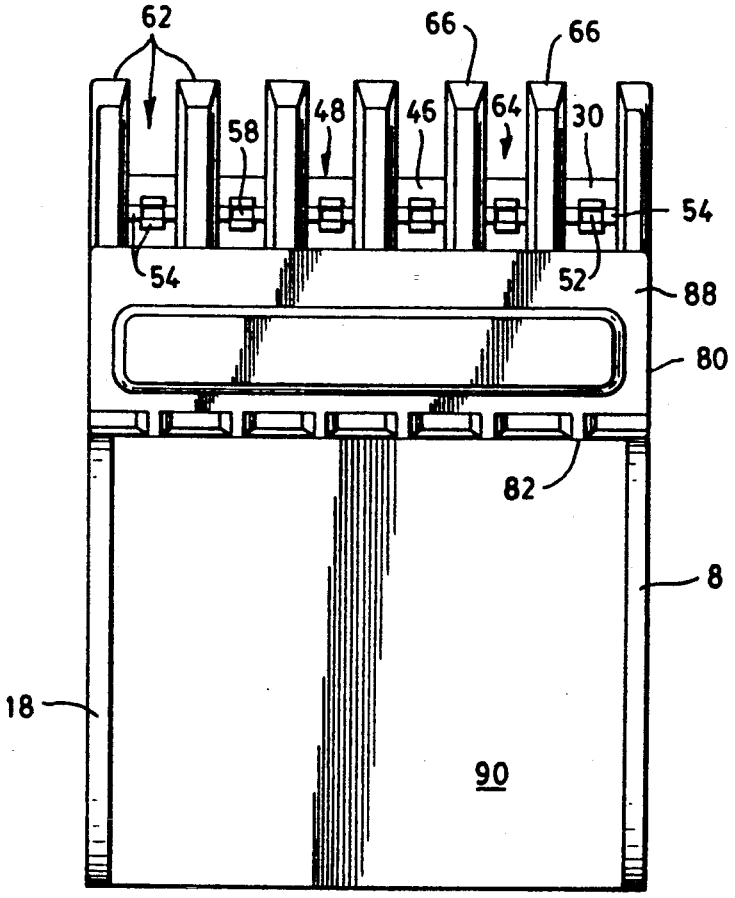
FIG. 6 is a top plan view thereof.

Attached to the support means 2, and extending forwardly therefrom, is a shelf means 60 having mounting means 62 thereon for the lubricating oil dispensers D. The shelf means 60 extends over the housing top wall 46. The mounting means 62 comprises, for each dispenser D, a recess 64 formed by two forwardly extending fingers 66 (FIG. 6), the recess 64 being adapted to receive and retain the lubricating oil dispenser D (FIG. 4) in such a manner as to have a nozzle portion N of the dispenser directed inwardly toward the podium, with a grip or handle portion G of the dispenser directed forwardly, or away from the podium.

The shelf means 60 is so configured as to define a trough 70 positioned to underlie each dispenser nozzle N, when the dispenser D is mounted on the mounting means 62. The trough 70 preferably is provided with a drain valve 72, located at the lowest point in the trough 70, for draining accumulated oil from the trough.

The podium is provided further with a shield means 80 mounted thereon and extending upwardly of the shelf means 60. The shield means 80 preferably comprises an upstanding wall 82 positioned in front of the nozzle portion N of each dispenser D when the dispenser is mounted on the mounting means 62. The wall 82 is disposed in a trajectory of lubricating oil dispensed from the dispenser D, when the dispenser is at rest on the mounting means and inadvertently activated by an operator. The shield means wall 82 is configured so as to guide any oil directed thereagainst to the trough 70. Preferably, the wall 82 is provided with grooves 84, each groove 84 being disposed forwardly of, and in alignment with, a dispenser nozzle N. The shield means 80 may also be provided with splash skirts 86 at either side thereof to further confine the effects of an accidental discharge of lubricating oil. The shield means 80 may still further be provided with a hood portion 88 for further insuring confinement of errant oil dispersions.

Shelves 90 may be attached to, and supported by, the side bars 10, 12, 22. The shelves 90 and/or the legs 4, 6, 14, 16 may be adapted to releasably retain bracket members 92, if desired.

The legs 6, 16 may be interconnected by a footbar 94 for the comfort and convenience of the operator, as well as for added rigidity to the skeletal frame. The front of the structure may be provided with a front plate 96, which may be an extension of the housing top wall 46.

In operation, the dispensers D are, when not in use, disposed in the mounting means 62, as above described, with the dispenser hoses H hanging from the dispensers and passing through the rollerways 58 and through the housing 30. The weight of the hoses urge the dispensers into firm engagement with the mounting means 62. The hoses H typically are stored within a compartment (not shown) beneath the floor on which rests the podium, and readily may be extended, such as to allow the dispensers to be brought to bear at a removed location. The dispensers are retained on the shelf 60, as noted above, with the handle portions G extending outwardly and the nozzle portions N extending inwardly of the podium. If, in grasping a handle portion G, the operator inadvertenly triggers discharge of a measure of oil, the oil is safely confined by the shield means 80 to the immediate area and not allowed to drop on the floor or splash against other objects. If, after return of the dispenser to the shelf 60 after use, there is drippage from the nozzle portion N, such drippage will be captured by the trough 70 and, again, not permitted to fall to the floor.

It is to be understood that the present invention is by no means limited to the particular construction herein disclosed and/or shown in the drawings, but also comprises any modifications or equivalents within the scope of the disclosure.

Having thus described our invention, what we claim as new and desire to secure by Letters Patent of the United States is:

1. A podium for a lubricating dispenser, said podium comprising support means adapted to stand upright on a horizontal floor, shelf means attached to said support means and extending outwardly therefrom, said shelf means having mounting means thereon for receiving and retaining said lubricating dispenser with a nozzle portion of said dispenser directed toward said support means and a grip portion of said dispenser extending away from said support means, said shelf means defining a trough positioned to underlie said dispenser nozzle when said dispenser is mounted on said mounting means.

2. The podium for a lubricating dispenser in accordance with claim 1, and further including shield means mounted on said podium and extending upwardly from said shelf means, said shield means comprising an upstanding wall positioned in front of said nozzle portion of said dispenser when said dispenser is mounted on said mounting means.

3. The podium for a lubricating dispenser in accordance with claim 2, in which said shield means is configured to guide oil received thereby to said trough.

4. The podium for a lubricating dispenser in accordance with claim 3, in which said shield means further comprises splash skirt means at either end of said upstanding wall.

5. The podium for a lubricating dispenser in accordance with claim 4, in which said shield means further comprises a hood portion at an upper end of said upstanding wall.

6. A podium for a lubricating dispenser, said podium comprising support means adapted to stand upright on a horizontal floor, a housing attached to said support means, said housing having a top wall extending transversely of the upright support means, said top wall having a hole therein adapted to have disposed therein a lubricating dispenser hose, said hose extending from said housing through said hole and connected to said dispenser, and shelf means attached to said support means and extending over said top wall, said shelf means having mounting means thereon for receiving and retaining said lubricating dispenser with a nozzle portion of said dispenser directed toward said support means, said shelf means defining a trough positioned to underlie said dispenser nozzle when said dispenser is mounted on said mounting means, such that a grip portion of said dispenser extends outwardly away from said support means.

7. The podium for a lubricating dispenser in accordance with claim 6, and further including shield means mounted on said podium and extending upwardly from said shelf means, said shield means comprising an upstanding wall positioned in front of said nozzle portion of said dispenser when said dispenser is mounted on said mounting means, such that said shield wall is disposed in a trajectory of lubricating oil dispensed from said dispenser when said dispenser is mounted on said mounting means and activated by an operator.

8. The podium for a lubricating dispenser in accordance with claim 7, in which said shield means is configured to guide said dispensed oil to said trough.

9. The podium for a lubricating dispenser in accordance with claim 8, and further including means for draining said trough.

10. The podium for a lubricating dispenser in accordance with claim 6, in which said support means comprises a skeletal frame.

11. The podium for a lubricating dispenser in accordance with claim 4, in which said shield means further comprises splash skirt means at either end of said upstanding wall.

12. The podium for a lubricating dispenser in accordance with claim 8 in which said shield means further comprises a hood portion at an upper end of said upstanding wall.

13. The podium for a lubricating dispenser in accordance with claim 11 in which said shield means further comprises a hood portion at an upper end of said upstanding wall.

* * * * *